US005293707A

United States Patent [19]

Shaeffer

[11] Patent Number: 5,293,707

[45] **Date of Patent: * Mar. 15, 1994**

[54] EFFICIENT INFLATING DEVICE

[76] Inventor: Henry W. Shaeffer, 825 Elyria Dr., Los Angeles, Calif. 90065

[ * ] Notice: The portion of the term of this patent subsequent to May 1, 2007 has been disclaimed.

[21] Appl. No.: 742,393

[22] Filed: Aug. 8, 1991

Related U.S. Application Data

[63] Continuation-in-part of Ser. No. 584,340, Sep. 18, 1990, abandoned.

[51] Int. Cl.[5] ..... G09F 19/02

[52] U.S. Cl. ..... 40/412; 40/214

[58] Field of Search ..... 116/DIG. 8, DIG. 9, 116/210; 446/220, 148, 178; 441/30; 40/411, 412, 214, 215

[56] References Cited

U.S. PATENT DOCUMENTS

| | | | |
|---|---|---|---|
| 3,078,607 | 2/1963 | Butler et al. | 446/178 |
| 3,473,966 | 10/1969 | Fritch | 136/135 X |
| 3,563,676 | 2/1971 | Coovert et al. | 446/220 X |
| 3,846,933 | 11/1974 | Hill et al. | 446/178 |
| 4,094,267 | 6/1978 | Davis, Jr. | 116/124 B |
| 4,271,620 | 6/1981 | Vicino et al. | 40/412 X |
| 4,330,953 | 5/1982 | Damiano | 40/412 X |
| 4,903,958 | 2/1990 | DiCarlo et al. | 272/27 N |
| 4,920,674 | 5/1990 | Shaeffer | 40/412 |
| 5,083,771 | 1/1992 | Tyner | 40/412 X |
| 5,108,337 | 4/1992 | Sloan et al. | 446/220 |

*Primary Examiner*—James R. Brittain
*Assistant Examiner*—Milton Nelson, Jr.
*Attorney, Agent, or Firm*—Thomas A. Turner, Jr.

[57] ABSTRACT

A self-inflatable balloon and motor-driven turbine assembly has a communication discernible on a surface of the balloon and has a pneumatically sealed enclosure for the turbine. The sealed enclosure has an outlet port and which, together with the inlet port, are positioned in relation to the turbine to permit efficient flow of air or other gas into the balloon when it is desired to inflate the balloon. The outlet port or the inlet port, depending upon the embodiment, seals an enclosure when selectively operated to a closed position to prevent leaking of the gas from the inflated balloon.

5 Claims, 5 Drawing Sheets

EFFICIENT INFLATING DEVICE

RELATED APPLICATION

This application is a continuation-in-part of my co-pending application Ser. No. 584,340 filed Sep. 18, 1990, now abandoned and entitled "Efficient Inflating Device" in my name. The benefit of that prior co-pending application pursuant to Title 35 of the United States Code, section 120 is claimed hereby.

BACKGROUND OF THE INVENTION

1. Field of the Invention:

The present invention relates to the art of communicating, and more particularly to efficient, selectively self-inflatable assemblies.

2. Description of the Prior Art:

In the past, it has been known to provide a balloon in combination with a source of air or like gas to inflate the balloon where, when the balloon is inflated, a message preprinted on the balloon becomes discernible to its recipient. In this regard, attention is called to my earlier U.S. Pat. No. 4,920,674, and to U.S. Pat. Nos. 4,020,786 issued to Kopeika and 3,563,676 issued to Coovert and Seitz. In these, and in other devices for inflating balloons, air or like gas is forced into a balloon through its mouth or opening to inflate the balloon, and the operation of the inflation is initiated upon some manipulation of the assembly. In the two letters patent to Kopeika and to Coovert and Seitz, the balloon is inflated by compressed gas, such as, for example, air which is released directly into the balloon when some cap is removed or when the balloon is forcibly held to make or complete a switched electrical circuit to drive an electrical motor compressor. In the case of the letters patent to Kopeika as identified above, the gas is compressed and maintained in a compressed state until released into the balloon. In the letters patent identified above issued to Coovert and Seitz and to myself, the air is drawn from the ambient air.

It is desired, however, to have a three dimensional message arrangement, such as a balloon as shown in the letters patent identified herein above, wherein the gas flow is so arranged as to provide for an efficient air or like gas flow into the balloon. Such an arrangement would allow for an inflation time that is quicker, and would permit the use of a smaller motor and turbine assembly. Moreover, the size of the balloon could be increased, and the number of times the balloon could be reinflated by the same power source would be increased.

SUMMARY

In brief, in accordance with one aspect of the present invention, a self-contained kit or assembly is shown having an uninflated balloon, and a turbine driven by a motor which operates upon electrical power supplied by a relatively small battery. A set of flexible stays are positioned surrounding the mouth of the balloon and are adapted to engage the balloon when it is inflated and thus to assist in holding upright the balloon so as to present the message on the balloon's surface.

The turbine, in one embodiment, as well as the motor and electrical power source are contained within an enclosure that is pneumatically sealed from the ambient environment. The sealed enclosure housing the motor, turbine and power source has three openable ports, at least two of which are pneumatically sealed when in the closed position. A first port is positioned above the turbine's blades, and need not be pneumatically sealed when not in use. Another, or second port is positioned at the mouth or entrance to the balloon and, when closed, is pneumatically sealed to hold air or like gas within the balloon. The third port is positioned in a convenient place to allow replacement or insertion of a power supply or source, such as a battery. The third port is pneumatically sealed when closed. A vane or channel may be formed from the first port to the second port.

The third port has a door which is shaped in relation to the opening so that when the door closes the opening, gas cannot flow through or past it. The door may have an edge which, when engaging the edge of the opening provides a pneumatically sealed closure. Alternatively or simultaneously, the door may be sized slightly larger than the opening, and the material of the door or of the enclosure having the opening is resilient to provide the pneumatically sealed closure.

The second port opens directly into the balloon's interior when the port is opened, and effectively seals all pneumatic passage or flow when the port is closed. A resilient sealing or O-ring is positioned around the second port's opening and within a seat. The interior of the balloon and the interior of the motor and turbine enclosure are separated by a sliding or revolving partition. When the partition is moved or revolved to match an opening therein with the opening of the port into the balloon's mouth or interior, the O-ring pneumatically seals the pneumatic passage from all exterior or extraneous gas intrusion or escape. Further, movement of the partition so as to open the second port will actuate a switch which electrically connects the motor to the power source, thus driving the turbine.

In an alternative embodiment, a compressor pump includes a housing enclosing a turbine, the housing having an inlet port with a door operable to a closed and to an opened position. The door is operated by movement of a switch button linked to the door and to an electrical circuit which is selectively closed or completed by movement of the switch button. The circuit in one configuration includes an electrical power supply to drive a motor to drive the turbine, and in the other configuration drives a sound synthesizer to broadcast predetermined sounds. When the door is in the closed position, the enclosure including the turbine is pneumatically sealed to prevent leaking of gas back through the pump or compressor, to maintain the balloon in the inflated position for as long as may be desired.

Other novel features which are believed to be characteristic of the invention, both as to organization and methods of operation, together with further objects and advantages thereof, will be better understood from the following description in which preferred embodiments of the invention are described by way of example.

DESCRIPTION OF THE PREFERRED EMBODIMENT

Figure 1:
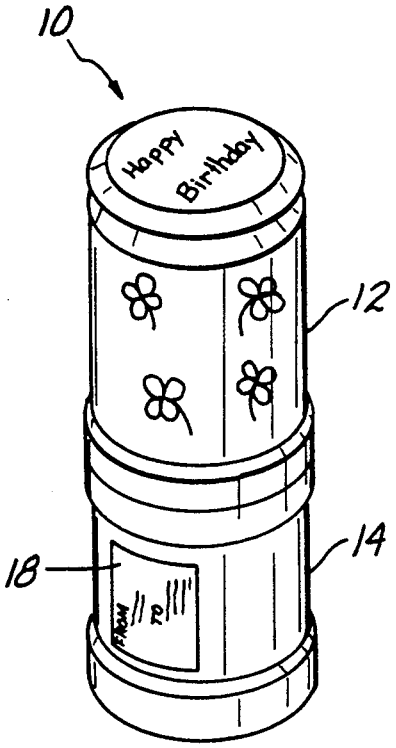
FIG. 1 is a perspective view of the preferred embodiment of the invention assembled and prepared for transport.

A container 10, reference being initially had to FIG. 1 of the accompanying drawings, is shown comprising the preferred embodiment of the present invention. The container 10 is cylindrical and has an upper enclosure defined by a covering or cap 12. The lower enclosure 14 completes the outside appearance of the assembly, which is provided with an address surface 18 which is treated so that one may inscribe an address thereon for posting.

Figure 2:
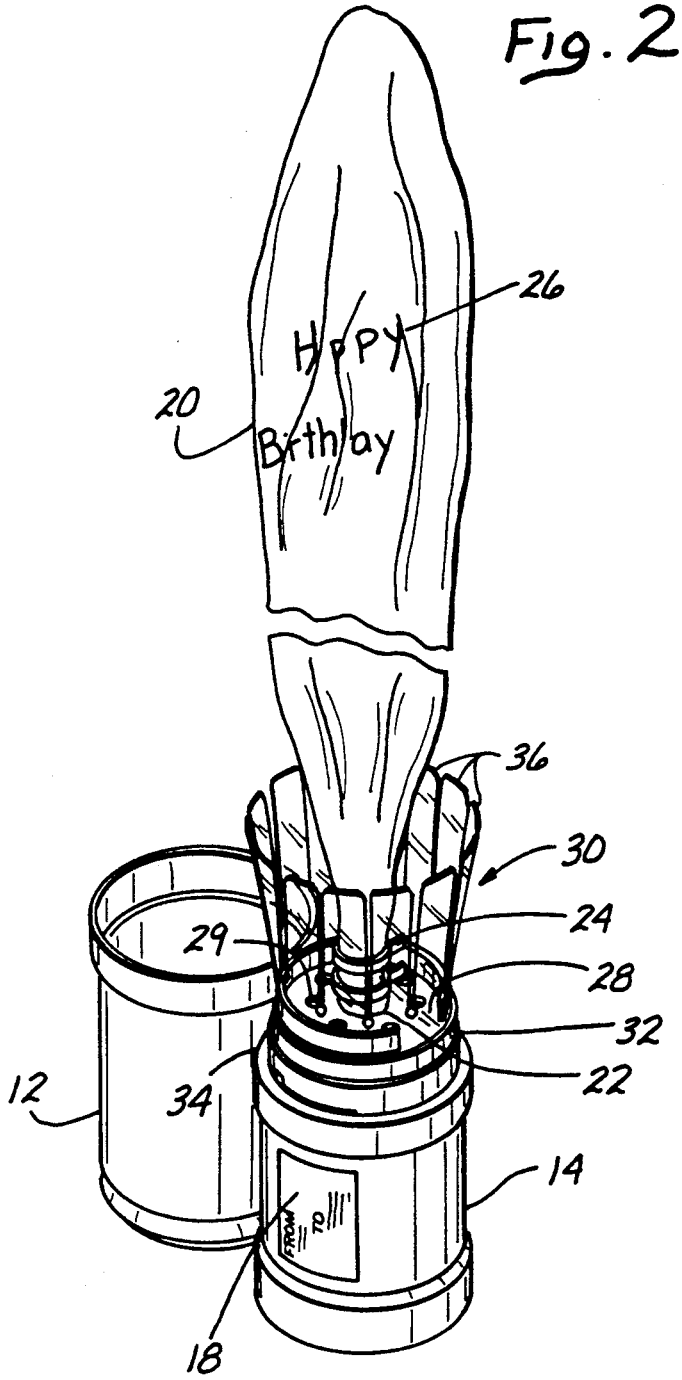
FIG. 2 is a perspective view of the preferred embodiment of the invention as seen in FIG. 1, having an upper enclosure covering removed and the message surface being inflated for discernment.

As seen in FIG. 2, the cap or covering 12 is removed to reveal the theretofore enclosed balloon 20 firmly attached to the enclosure 14 through the balloon's opening mouth 22, which is held tightly by cinches 24 to a nozzle, described in greater below. The balloon 20 has on its surface indicia 26 which can give a message when the balloon 20 is inflated.

The lower enclosure 14 has an upper partition 28 having air holes 29 spaced generally around its periphery. A flexible stay structure 30 is held securely to the upper partition 28 by brace 34 which is fixed to the partition 28. The stay structure 30 includes a series of stays 36 depending upwardly from the base 32 of the stay structure 30 and away from the partition 28. The stays 36 are free at their upper ends and are designed to engage the balloon 20 when it is inflated, to maintain the balloon 20 in an upright stance, as may be seen better in FIG. 3.

Figure 3:
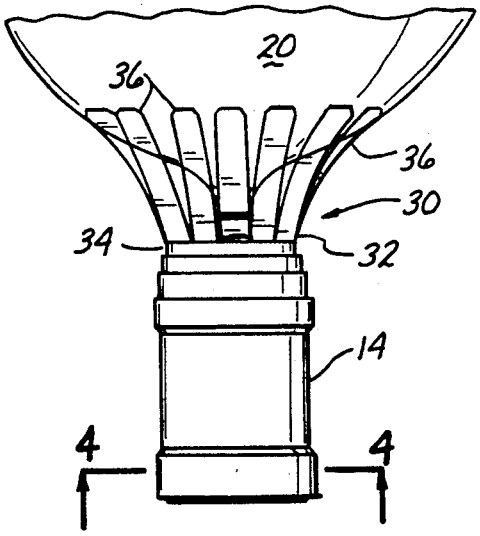
FIG. 3 is a side elevation view of a portion of the preferred embodiment as seen in FIGS. 1 and 2, showing the balloon inflated.

In FIG. 3, the balloon 20 is shown extending from the lower enclosure 14 in the inflated stance, engaging and flexing the stays 36 outwardly from their lower ends which attach to and form the base 32 of the stay structure 30. The stay structure 30 is held to the lower enclosure 14 at the brace 34. In this manner, the lower enclosure provides a base or stand for the balloon 20 while it is in the inflated stance.

Figure 4:
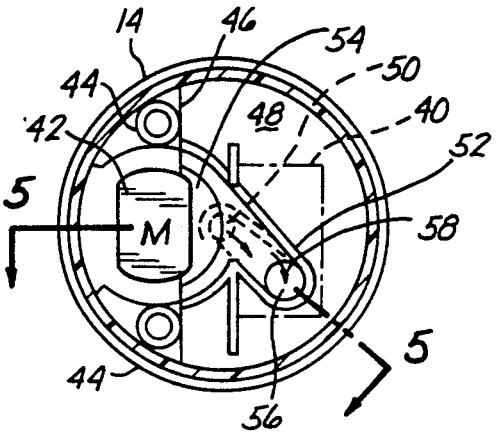
FIG. 4 is a cross-sectional view of the lower enclosure taken along line 4—4 of FIG. 3, showing the assembly of the motor and channel.

FIG. 4 is cross-sectional view of the lower enclosure 14 taken along, and looking upwardly from line 4—4 in FIG. 3. In FIG. 4, a battery 40, shown in phantom in this view, is placed alongside a motor 42. Motor mount pegs 44 fixed to the lower enclosure 14 extend to receive the motor mount plate 46. The motor 42 is mounted upon the motor mount plate 46.

A first opening or inlet port 50 is formed in the upper ceiling 48 and is shown in phantom in this view, generally within the boundary defined by a channel or vane 52 and behind the turbine 54. A second opening or port 56 is formed in the ceiling 48. Air flow 58 is guided by the channel 52 in the direction of arrows 58 when the turbine 54 is rotating, as will be described in greater detail below.

Figure 5:
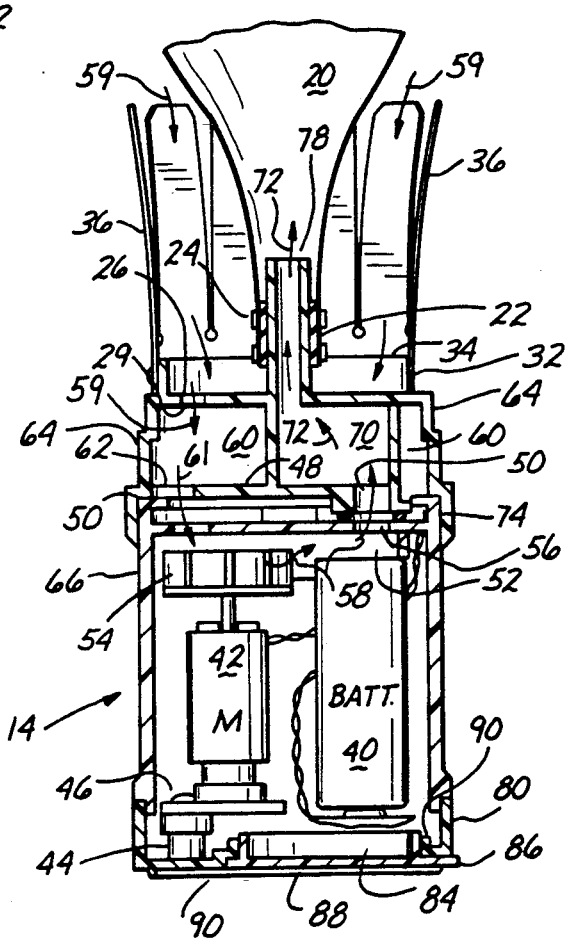
FIG. 5 is a side elevation cross-sectional view taken along line 5—5 of FIG. 4 showing the assembly of the operational components of the preferred embodiment of the present invention.

The placement of the battery 40, motor 42 and turbine 54 can be better seen in FIG. 5, which is side elevation cross-sectional view taken along line 5—5 of FIG. 4, wherein the motor 42 is shown mounted on mounting plate 46, which in turn is mounted on mounting pegs 44 which are part of, or at least are fixed to the lower enclosure 14.

In FIG. 5, the lower enclosure 14 is shown having a chamber 60 which opens through opening 62 into a small air pocket separating the ceiling 56 from the chamber 60. As shown, the chamber 60 extends substantially around the periphery of the rotatable section 64, which mounts upon and is rotatable in relation to the lower cylindrical wall 66. When the turbine 54 is rotating, air is drawn in the direction of arrows 59 through the air holes of the upper partition 28 into the chamber 60, and further in the direction of arrow 61 through the first port 50 into the lower enclosure generally. The air is channeled by vane 52 to flow in the direction of arrows 58 to the second port 56. As will be described in greater detail below, the remainder of the lower enclosure is pneumatically sealed so that air neither is drawn into nor escapes from it.

As indicated, the air is forced in the direction of arrows 58 through the second port 56, and into the chamber 70. An O-ring 74 is seated around the mouth of the chamber 70. When the section 64 is rotated so that the mouth of chamber 70 is positioned in pneumatically open relation with the second port 56, the O-ring 74 pneumatically seals the air passage through second port 56. As important, when the section 64 is rotated so that the mouth of the chamber 70 is away from the second or outlet port 56, the O-ring 74 engages the ceiling tightly, so that the chamber 70 is sealed pneumatically at its mouth, allowing air neither to enter nor escape therefrom. When the turbine 54 is rotating and the mouth of chamber 70 is positioned pneumatically open with respect to the second or outlet port 56, air is forced in the direction of arrows 72 through the chamber 70 into the nozzle 78 and into the interior of the balloon 20 through its mouth 22. The balloon opening or mouth 22 is held firmly onto the nozzle 78 by cinches 24, as shown. The stays 36, secured at their base 32 to the brace 34 of the lower enclosure 14, will engage the balloon 20 when it is inflated. When the section 64 is rotated so that the mouth of chamber 70 is sealed pneumatically, air from the interior of the balloon 20 cannot escape, and the interior of the balloon 20 becomes an integral air chamber with the chamber 70. Electrical leads 76 connect the battery 40 with the motor 42 and the electrical circuit is designed that the motor 42 can be turned on and off as selected or predetermined. The turbine 54 is axially connected to the drive shaft of the motor 42 so that the turbine 54 rotates upon energization of the motor 42.

The base 80 of the lower enclosure 14 is secured in airtight relation at the lower end of the cylindrical wall 66. The base 80 has an opening which is closed by a cap or door 84. The door 84 has a tab 86 extending slightly beyond the periphery of the cylindrical exterior of the lower enclosure 14. With tab 86, one can engage the door 84 and pry it away from the base 80 and, thus, open the opening. The door 84 has a cylindrical flange extending around its periphery upwardly.

Figure 6:
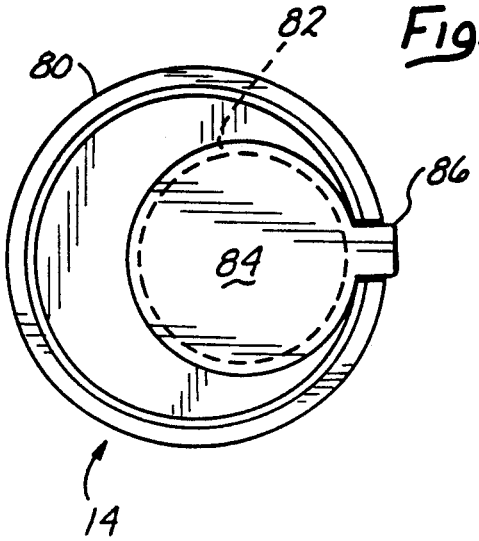
FIG. 6 is a bottom view of the lower enclosure showing the third port in a closed position.

As seen by viewing FIGS. 5 and 6 of the drawings, FIG. 6 being a bottom view of the lower enclosure 14, the opening 82, shown in phantom, is defined by the opening edge 90, which is adapted to engage the flange 88 of the door 84. The material for the door 84, or the base 80, or both is resilient. The diameter of the flange 88 of the door 84 is formed slightly larger than the diameter of the edge 90 of the opening 82. Thus, when the door 84 is inserted into the opening 82, the engagement of the edge 90 with the flange 88 is pneumatically air tight. The door 84 and opening 82 are formed within the base 80 so that when the door 84 is removed, the opening is aligned with the vertical position of the battery 40, and the battery 40 can be removed and replaced.

Figure 7:
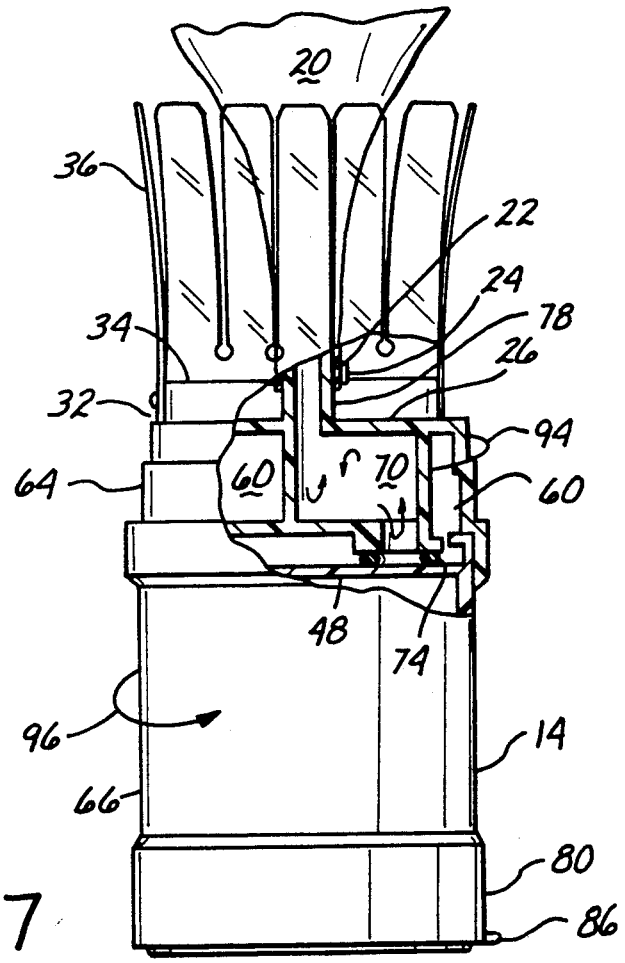
FIG. 7 is a side elevational view of a portion of the assembly having a portion cut away for clarity in showing the operation of the preferred embodiment of the present invention.

In FIG. 7, a partial cut away, side elevation view of the assembly is shown. The balloon 20, in this view, is inflated at least partially and the stays 36 will engage the balloon 20. The stays 36 are connected at the base 32 of the stay structure 30, which is secured to the lower enclosure 14 at brace 34. The mouth 22 of the balloon 20 is secured to the nozzle 78 by cinches 24.

In the view of FIG. 7, however, the section 64 is rotated in the direction of arrow 94 and the wal 66 is rotated in the direction of arrow 96, both with respect to the positions shown in FIG. 5 for comparison, so that the mouth of chamber 70 is positioned over the ceiling 48, and the O-ring 74 creates a pneumatically air tight seal between the chamber 70 and the remainder of the interior of lower enclosure 14. In this manner, the interior of the balloon 20 is sealed from the ambient. The chamber 70 remains in pneumatically relation with the interior of the balloon 20.

In operation, the container 10 of the balloon assembly is received as shown in FIG. 1. The cap 12 is removed, and the motor 42 is driven by the battery through leads 76. The section 64 is rotated in the position that places the mouth of the chamber 70 in pneumatically open relation with the second port 56. When the motor 42 is driven, the turbine 54 draws air from the ambient in the direction of arrows 59 through the air holes 29 in the upper partition 26, into chamber 60. The air continues to be drawn, through opening 62 in the direction of arrow 61 and through first or inlet port 50 into the blades of the turbine 54. The air is channeled by vane 52 to the second or outlet port 56. The air is then forced through the mouth of the chamber 70 into the chamber 70 in the direction of arrows 58. Since the chamber 70 is pneumatically connected to the interior of the balloon 20 through nozzle 78, air is forced in the direction of arrows 72 to fill the balloon 20.

It has been found that it is helpful that there be no air leak in the remainder of the lower enclosure during the balloon filling operation. Thus in this embodiment, it is important that air be held within the interior of the lower enclosure 14, and not allowed to escape through the opening 82 and, in this regard, the door 84 pneumatically seals the opening when properly placed as shown in the accompanying drawings.

When the balloon 20 is inflated, the balloon 20 engages the stays 36 which hold the balloon 20 upright to expose the message 26 on its surface to the recipient. The section 64 is rotated in the direction of arrow 94 in relation to the wall 66, which is rotated in the direction of arrow 96, to position the mouth of the chamber 70 over the ceiling 48 and, thus, seal the chamber 70 and the interior of the balloon 20 from the ambient. In this manner, the balloon 20 is maintained in an inflated stance for as long as desired. By rotating the section 64 in relation to the wall 66, as described, the electrical circuit connecting the battery 40 with the motor 42 is broken, and the motor is cut "off," and the turbine 54 is still.

Figure 8:
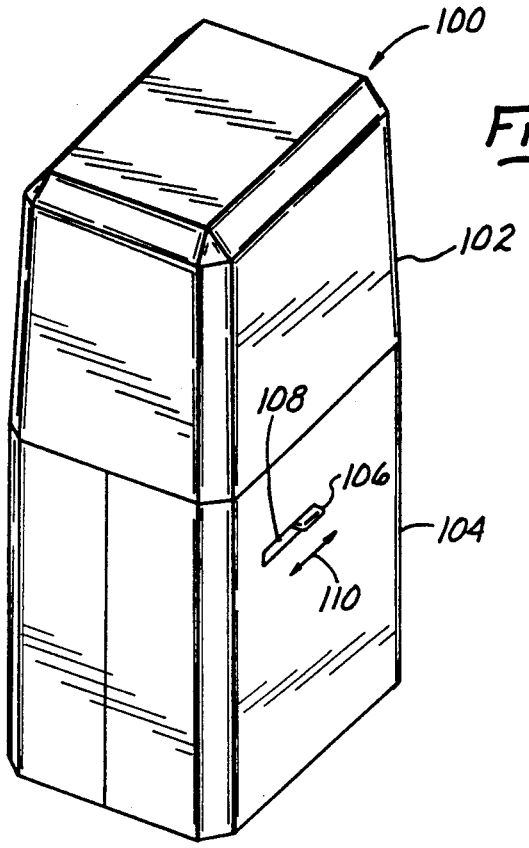
FIG. 8 is a perspective view of an alternative embodiment of the present invention, showing the invention in a packaged mode.

An alternative embodiment of the present invention is shown in FIG. 8, which is a perspective view of a container 100 having a covering or cap 102 fitting over a lower compartment 104. The lower compartment 104 has a switch button 106 protruding through slot 108, so that the switch button 106 can be moved in the directions of arrows 110. The lower compartment has an outside surface which is specially prepared to receive and retain ink, so that the container 100 can be marked for identification or addresses can be inscribed on it.

Figure 9:
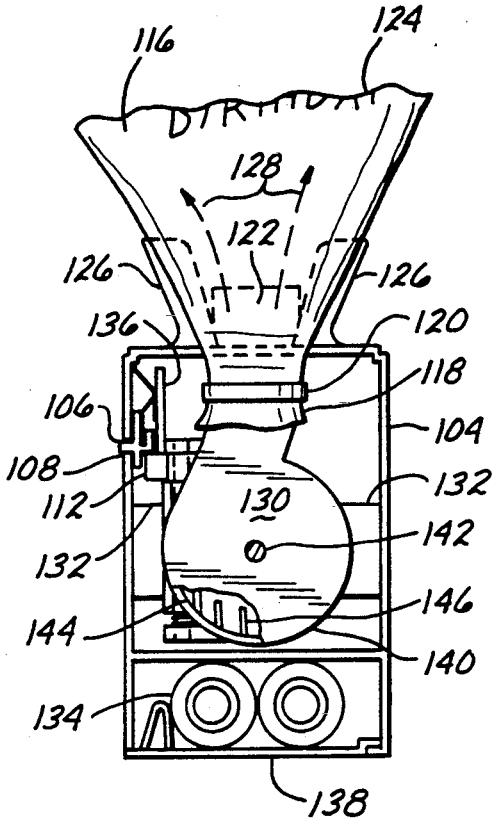
FIG. 9 is a side elevation, partially cut away view of the alternative embodiment of FIG. 8, showing the invention in a balloon inflated mode.

As in the first embodiment described herein, the cap 102 can be removed to reveal a deflated balloon 116, better seen in FIG. 9. In FIG. 9, the cap 102 is removed and portions of the container 100 are cut away for clarity in description. The switch button 106 is shown protruding through the lower compartment 104 in slot 108. The switch button is mechanically linked to lever 112, which will be described in greater detail below in connection with the door of the compressor.

Figure 10:
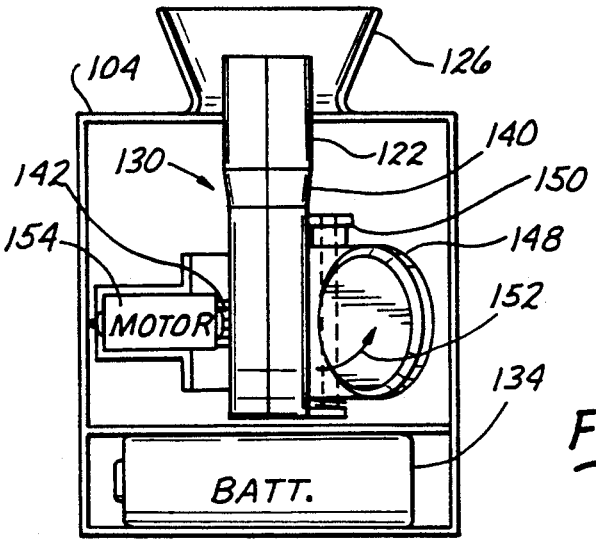
FIG. 10 is a side elevation, partially cut away view of the alternative embodiment of FIG. 8 taken from a different side than the view of FIG. 9.

An inflatable balloon 116 has an opening mouth 118 which is fitted over the nozzle or outlet port 122, shown only in phantom in the view of FIG. 9 but better seen in FIG. 10. The opening or mouth 118 of the balloon 116 is held onto the nozzle by cinch 120 tightly holding the balloon's opening 118 against the outside of the nozzle 122. Indicia 124 is printed or otherwise formed on the outside or visible surface of the balloon 116.

In this embodiment, the stays 126 are permanently or rigidly formed to be upstanding from the top of the lower compartment 104. Air or like gas, or fluid is forced in the direction of arrows 128 through the nozzle or outlet port 122 into the interior of the balloon by action of the compressor pump 130.

The compressor pump 130, sometimes called the compressor and at other times called a pump, is mounted to the interior of the lower compartment 104 through mount bushings 132. Batteries 134 are held in a sub-compartment in the lower compartment 104, and selectively close or connect in circuit with the printed circuit board ("PCB") 136 which contains a sound synthesizer for broadcasting predetermined sounds. The batteries are held in place behind door 138, which in this embodiment need not create a pneumatic seal.

The compressor or pump 130 includes a housing 140, which is pneumatically sealed except for the openable door when in an opened position, as will be explained in greater detail below. The compressor 130 comprises an axle 142 connecting to a rotor or turbine 144 having a series of vanes 146 which impel the air or other gas or fluid in the direction of arrows 128 when the rotor 144 is driven.

As better seen in FIG. 10, a door 148 is mounted in rotating relationship by hinge 150 to the compressor housing 140. When the door 148 is opened in the direction of arrow 152, air can be received into the interior of the housing 140. The nozzle or outlet port 122 feeds air or other gas or fluid into the interior of the balloon held up by the stays 126. An electrical motor 154 is connected to the turbine by axle 142.

Figure 11:
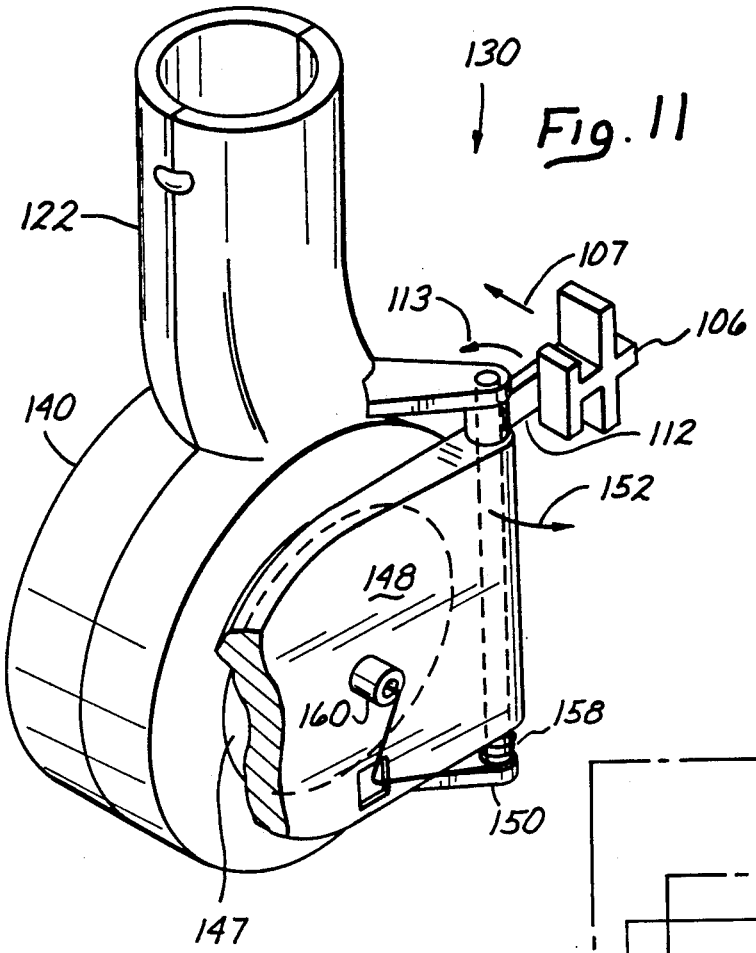
FIG. 11 is a perspective view of the compressor pump of the alternative embodiment of the present invention, showing parts of the enclosure cut away for clarity in description; and, FIG. 12 is an electrical schematic of the circuit and power source for operating the alternative embodiment of FIG. 8.

In FIG. 11, the compressor 130, sometimes called a pump 130 or compressor pump 130, is seen in greater detail in the perspective view. The compressor 130 and its housing 140, nozzle or outlet port 122 and door 148 comprise an air sealed enclosure when the door is in the closed position. The door 148 is attached rotatingly to the housing 140 by a hinge 150, around the axis of which the door 148 rotates in the direction of arrow 152, as shown. The door 148 in the perspective view of FIG. 11 is in the closed position, and has portions thereof cut away for clarity in description. The cut away portion reveals the opening or inlet port 147 through which air or other gas or fluid passes when the turbine of the present invention is operated.

A spring 158 biases the door 148 in the closed position by engaging the door 148 with bumper 160 placed upon the tip of the extension of the spring 158. The lever 112 is fixed in relation to the door 148, so that when the lever 112 is moved in the direction of arrow 113, the door 148 will move in the direction of arrow 152. The lever 113 is forced to move in the direction of arrow 112 upon engagement with the switch button 106, which mechanically engages the lever 112, when the switch button 106 is moved in the direction of arrow 107. When the switch button 106 is moved in the direction opposite to that of arrow 107, the bias of the spring 158 forces the door to close, sealing the opening or inlet port 147.

Figure 12:
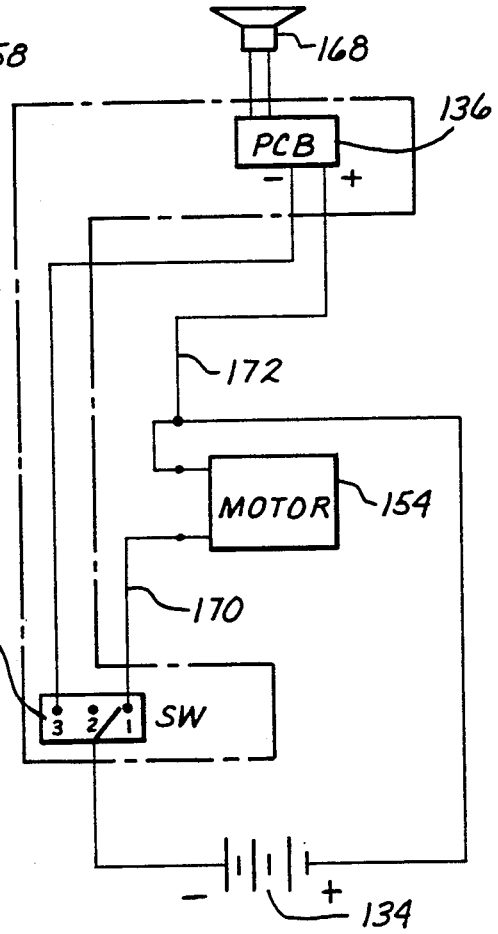

In FIG. 12, the power for driving the turbine 144 and synthesizer and circuit 136 is shown in schematic detail. The electrical power source is comprised of batteries 134 selectively connected in series circuits 170, 172. The selection is made by operation of switch 166. One circuit, if selected comprises the batteries 134 connected in series with the motor 154 to complete circuit 170. Another selectable circuit 172 comprises the batteries 134 in series with the printed circuit board and its sound synthesizer 136. The printed circuit board 136 has a loudspeaker 168 connected therein to broadcast the predetermined sound on the synthesizer and circuit 136.

The selections of the circuits is made by switch 166 which has three positions marked for convenience position "1," "2" and "3. " The switch 166 is operated by movement of the switch button 106 along slot 108. When the switch 166 is in the position "1", the motor 154 is connected in a closed or completed series circuit 170 with the electrical power source or batteries 134, to cause the motor to rotate. The rotor of the motor 154 drives the turbine 144 through axle 142 which connects the two together. In the mode of closed circuit 170, when the switch button 106 is moved to close the switch 166 into position "1," the button engages the lever 112 by movement in the direction of arrow 107, forcing the lever 112 to move in the direction of arrow 113 which results in the opening of the inlet port 147 by swinging the door 148 in the direction of arrow 152. Air or other gas or fluid is forced by the rotating turbine 144 through the nozzle or outlet port 122 in the direction of arrows 128 into the interior of the balloon 116 to inflate the balloon 116 upwardly against the stays 126, which hold the balloon upstanding.

When the switch button 106 is moved in an opposite direction to the direction of arrow 107, the switch 166 is in a position other than position "1" and the spring 158 closes the door 148 to create the enclosed housing 140 sealed to prevent air or other gas or fluid from passing therethrough. When the switch button 106 is moved to put switch 166 in position "3," circuit 172 is closed to electrically connect printed circuit board 136 and its sound synthesizer in closed circuit with the batteries 134 to broadcast over the loudspeaker 168 the predetermined sound of the synthesizer 136. The synthesizer is turned "off" merely by moving the switch button 106 to place the switch 166 in position "2." In position "2" the door 148 is sealed shut to form with housing 140 a pneumatically sealed enclosure, preventing the air within the balloon 116 from escaping, and the balloon 116 is held in an inflated mode until the door 148 is opened or until the balloon's opening mouth 118 is removed from the nozzle or outlet port 122 by removing the cinch 120. The batteries 134 can be replaced as needed by opening the door 138.

In operation, the cap 102 is removed to reveal the balloon 116 in an deflated mode. The switch button 106 is slid along the slot 108 in the direction of arrow 106 to place switch 166 in position "1." In this position, the lever 112 is moved in the direction of arrow 113 to move the door 148 open in the direction of arrow 152 and against the bias of spring 158 around hinge 150, thus opening the inlet port 147 of the housing 140. In this position "1," further, circuit 170 is closed and the motor 154 is energized to drive axle 142 and the connected turbine rotor 144 of the compressor pump 130. The rotating of the turbine 144 forces air received through inlet port 147 by the vanes 146 into nozzle 122 and into the interior of balloon 116 to inflate the balloon 116. The balloon 116 when inflated rests against the stays 126 to remain upstanding, to reveal the inscribed indicia 124 on its surface.

When the switch button 106 is slid to open the circuit 170 and cut the motor "off," the door 148 is shut against and seals the opening or inlet port 147 by the action of the spring 158 through bumper 160. When the door 148 is shut, it seals the enclosure defined by the housing 140 to prevent the air from escaping from the balloon 116.

When the switch button 106 is moved further to place the switch 166 in position "3," the circuit 172 is closed connecting in series circuit the sound synthesizer and circuit 136 and its loudspeaker 168 with the electrical power source, the batteries 134 so that predetrmined sound is broadcast. The sounds can be terminated by switching the switch 166 into position "2" and opening the circuit 172.

The foregoing detailed description of my invention and of preferred embodiments, as to products, compositions and processes, is illustrative of specific embodiments only. It is to be understood, however, that additional embodiments may be perceived by those skilled in the art. The embodiments described herein, together with those additional embodiments, are considered to be within the scope of the present of the present invention.

I claim:

1. In combination:

a) an inflatable balloon having an interior and an opening mouth;

b) pump means having an inlet port and an outlet port, said outlet port being pneumatically connected to said opening mouth of said inflatable balloon, for pressurizing gas at said outlet port and in the interior of said balloon;

c) switch means operably connected to said pump means for starting and stopping said pump means; and, d) door sealing means operably connected to said switch means for selectively preventing the passage of gas through said opening mouth when said switch means is operated for stopping said pump means, and for selectively sealing at least one of said inlet port and said outlet port.

2. The combination of claim 1 wherein said pump means includes a pneumatically sealable enclosure and a pump having a turbine, and wherein said turbine is positioned within said enclosure.

3. The combination of claim 2 wherein said inlet port is positioned in said enclosure and said switch means includes a switch button and said sealing means includes a door linked to said switch button and selectively operable into a closed position and an open position by movement of said switch button.

4. The combination of claim 3 wherein said door in the closed position pneumatically seals the inlet port to prevent escape of gas therethrough.

5. The combination of claim 3 wherein said inlet port is positioned in close proximity to said turbine.

* * * * *